US011114058B2

(12) United States Patent
Xiao

(10) Patent No.: US 11,114,058 B2
(45) Date of Patent: Sep. 7, 2021

(54) METHOD OF V-BY-ONE (VBO) SIGNAL PROCESSING FOR SAVING HARDWARE RESOURCES, DEVICE, AND TERMINAL THEREOF

(71) Applicant: TCL CHINA STAR OPTOELECTRONICS TECHNOLOGY CO., LTD., Guangdong (CN)

(72) Inventor: Guangxing Xiao, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/646,141

(22) PCT Filed: Mar. 6, 2020

(86) PCT No.: PCT/CN2020/078189
§ 371 (c)(1),
(2) Date: Mar. 11, 2020

(87) PCT Pub. No.: WO2021/134909
PCT Pub. Date: Jul. 8, 2021

(65) Prior Publication Data

US 2021/0201845 A1 Jul. 1, 2021

(30) Foreign Application Priority Data

Dec. 30, 2019 (CN) ..... 201911391500.1

(51) Int. Cl.
*G09G 3/36* (2006.01)
*G09G 5/00* (2006.01)
*G09G 5/02* (2006.01)

(52) U.S. Cl.
CPC ..... *G09G 5/008* (2013.01); *G09G 3/36* (2013.01); *G09G 5/024* (2013.01)

(58) Field of Classification Search
CPC . G09G 3/3685; G09G 3/3688; G09G 2310/08
See application file for complete search history.

(56) References Cited

U.S. PATENT DOCUMENTS

2018/0114504 A1* 4/2018 Zhang ..... G09G 5/008
2020/0169692 A1* 5/2020 Wang ..... G09G 5/14

* cited by examiner

*Primary Examiner* — Roy P Rabindranath
(74) *Attorney, Agent, or Firm* — Mark M. Friedman

(57) ABSTRACT

A method of V-By-One (VBO) signal processing for saving hardware resources, and a device and terminal thereof are provided. The method includes steps of: obtaining a plurality of VBO signals transmitted through data lanes respectively and having a same descrambling reset flag; resolving each of the VBO signals to obtain a valid data strobe signal; selecting one valid data strobe signal as a synchronization strobe signal and performing time-delay processing to obtain a delay strobe signal; and writing signals alternately into a first register and a second register under control of the synchronization strobe signal and reading signals alternately from the second register and the first register under control of the delay strobe signal based on the same descrambling reset flag.

5 Claims, 6 Drawing Sheets

METHOD OF V-BY-ONE (VBO) SIGNAL PROCESSING FOR SAVING HARDWARE RESOURCES, DEVICE, AND TERMINAL THEREOF

TECHNICAL FIELD

The present application relates to the field of V-BY-ONE (VBO) signal processing technology. More specifically, the present invention provides a method of VBO signal processing for saving hardware resources, and a device and terminal thereof.

BACKGROUND

VBO signal is short for V-By-One signal. VBO technology is a digital interface standard technology of image-oriented information transmission. As the VBO technology can support up to 4.0 Gbps high-speed signal transmission, a problem of time-delay between data and clock in a traditional receiver can be effectively prevented by a unique encoding method thereof. Therefore, the VBO technology has been widely applied to a field of ultra-high-definition liquid crystal display televisions (LCD TVs), thereby making ultra-thin and ultra-narrow TVs possible.

After a successful handshake between a control board of an LCD terminal (TCON, timing controller) and a main board, VBO signals are transmitted through multiple lanes while entering display communication. For any one of the VBO signals transmitted through the lanes, a conventional scheme is that the VBO signals transmitted through the respective lanes are cached, written, and read respectively. Such method must rely on linebuffers (or linebuffs) corresponding to the respective lanes. Thus, in each of the linebuffers (or linebuffs), the VBO signals are read and written based on respective descrambling reset flags (BE_SR) of the VBO signals transmitted through the respective lanes, thereby completing processing and receiving of the VBO signals. Obviously, a large number of the linebuffers (or linebuffs) must be used in the conventional scheme, and the number of the linebuffers will increase as the lanes increase in number. Such method of relying on a large number of linebuffers and independently reading signals transmitted through the respective lanes requires occupying a large amount of hardware resources, thereby leading to a significant increase in cost of processing the VBO signals.

Therefore, how to effectively reduce the use of hardware resources in processing all of the VBO signals transmitted through the lanes has become a technical problem that urgently needs to be solved as well as a focus of research for persons skilled in this art.

Technical Solution

In order to resolve a problem of excessive hardware resource occupation in a conventional VBO signal processing scheme, the embodiment of the present application provides a method of VBO signal processing for saving hardware resources, and a device and terminal thereof. It innovatively proposes a solution to read and write VBO signals based on a same descrambling reset flag that all of the VBO signals transmitted through lanes have, and a processing of the VBO signals can be optimized, thereby completely resolving the problem of excessive hardware resource occupation in the prior art.

In order to achieve technical objectives described above, an embodiment of the present invention specifically provides a method of VBO signal processing for saving hardware resources, comprising steps of:

obtaining a plurality of VBO signals transmitted through data lanes respectively and having a same descrambling reset flag;

processing and resolving each of the VBO signals to obtain a data signal and a control signal of each of the VBO signals, wherein the control signal comprises a valid data strobe signal;

selecting one control signal from all of the control signals as a synchronization signal, and using the valid data strobe signal comprised in the synchronization signal as a synchronization strobe signal;

obtaining a delay strobe signal by performing time-delay processing on the synchronization strobe signal, in which a duration of delay is one or more VBO signal receiving clocks;

writing the data signal and the control signal alternately into a first register and a second register under control of the synchronization strobe signal based on the same descrambling reset flag that all of the VBO signals have, in which the first register and the second register operate synchronously; and reading the data signal and the control signal alternately from the second register and the first register under control of the delay strobe signal based on the same descrambling reset flag that all of the VBO signals have.

Further, processing and resolving each of the VBO signals comprises steps of:

a deserializer step, converting an obtained serial VBO signal into a parallel VBO signal;

a decoder step, decoding the parallel VBO signal into an identifiable signal;

a descrambler step, descrambling the identifiable signal; and an unpacker step, unpacking the descrambled identifiable signal to obtain the data signal and control signal of each of the VBO signals.

Further, a signal receiving clock is taken as a working clock in writing the data signal and the control signal alternately into the first register and the second register.

Further, a system clock is taken as a working clock in reading the data signal and the control signal alternately from the second register and the first register.

Further, in the step of processing and resolving each of the VBO signals, the control signal further comprises a field synchronization signal and a row synchronization signal.

In order to achieve the technical objectives described above, an embodiment of the present invention specifically provides a device of VBO signal processing for saving hardware resources, comprising a signal obtaining module, a signal analysis module, a signal synchronization module, a time-delay processing module, a signal writing module, and a signal reading module;

wherein the signal obtaining module is configured to obtain a plurality of VBO signals transmitted through data lanes respectively and having a same descrambling reset flag;

wherein the signal analysis module is configured to process and resolve each of the VBO signals to obtain a data signal and a control signal of each of the VBO signals, and the control signal comprises a valid data strobe signal;

wherein the signal synchronization module is configured to select one control signal from all of the control signals as a synchronization signal, and is configured to use the valid data strobe signal comprised in the synchronization signal as a synchronization strobe signal;

wherein the time-delay processing module is configured to obtain a delay strobe signal by performing time-delay processing on the synchronization strobe signal, in which a duration of delay is one or more VBO signal receiving clocks;

wherein the signal writing module is configured to write the data signal and the control signal alternately into a first register and a second register under control of the synchronization strobe signal based on the same descrambling reset flag that all of the VBO signals have, in which the first register and the second register operate synchronously; and wherein the signal reading module is configured to read the data signal and the control signal alternately from the second register and the first register under control of the delay strobe signal based on the same descrambling reset flag that all of the VBO signals have.

Further, the signal analysis module comprises a deserializer module, a decoder module, a descrambler module, and an unpacker module;

wherein the deserializer module is configured to convert an obtained serial VBO signal into a parallel VBO signal;

wherein the decoder module is configured to decode the parallel VBO signal into an identifiable signal;

wherein the descrambler module is configured to descramble the identifiable signal; and wherein the unpacker module is configured to unpack the descrambled identifiable signal to obtain the data signal and control signal of each of the VBO signals.

Further, the signal writing module is configured to take a signal receiving clock as a working clock in writing the data signal and the control signal alternately into the first register and the second register.

Further, the signal reading module is configured to take a system clock as a working clock in reading the data signal and the control signal alternately from the second register and the first register.

In order to achieve the technical objectives described above, an embodiment of the present invention specifically provides a terminal, which is a liquid crystal display terminal, and the terminal comprises any one of the equipment of VBO signal processing for saving hardware resources.

The beneficial effects of the present invention are:

The present invention innovatively makes the VBO signals transmitted through the respective lanes adopt the same descrambling reset flag. Under control of the synchronization strobe signal and the delay strobe signal, and based on the same descrambling reset flag, all of the VBO signals transmitted through the lanes are synchronized by a way that the data signal and the control signal are alternately written into and read from the first register and the second register. Therefore, the technical objectives of reducing the linebuffers and preventing the use of excessive hardware resources are achieved, thereby significantly reducing cost of the liquid crystal display devices.

Based on the VBO signal processing scheme with the same descrambling reset flag and the reading of the dual registers, the linebuffers can be greatly reduced, and a large amount of hardware resources is saved on the basis of completing the VBO signal processing according to the present invention. It can completely resolve the waste of hardware resources in the prior art.

Hardware complexity is significantly reduced and software design logic is simplified on premise of improving the accuracy and reliability of VBO signal transmission according to the present invention. It is suitable for driving large-screen liquid crystal display (LCD) terminals, such as LCD TVs. It has a broad market application prospect and is suitable for large-scale promotion and application.

DESCRIPTION OF DRAWINGS

In order to clearly illustrate technical solutions of the embodiments of the present invention, a brief description of drawings used in each of the embodiments would be given as below. Obviously, the drawings in the following description are merely some embodiments of the present invention. For persons skilled in this art, other drawings can be obtained from these drawings under premise of no creative efforts made.

DETAILED DESCRIPTION OF PREFERRED EMBODIMENTS

Figure 1:
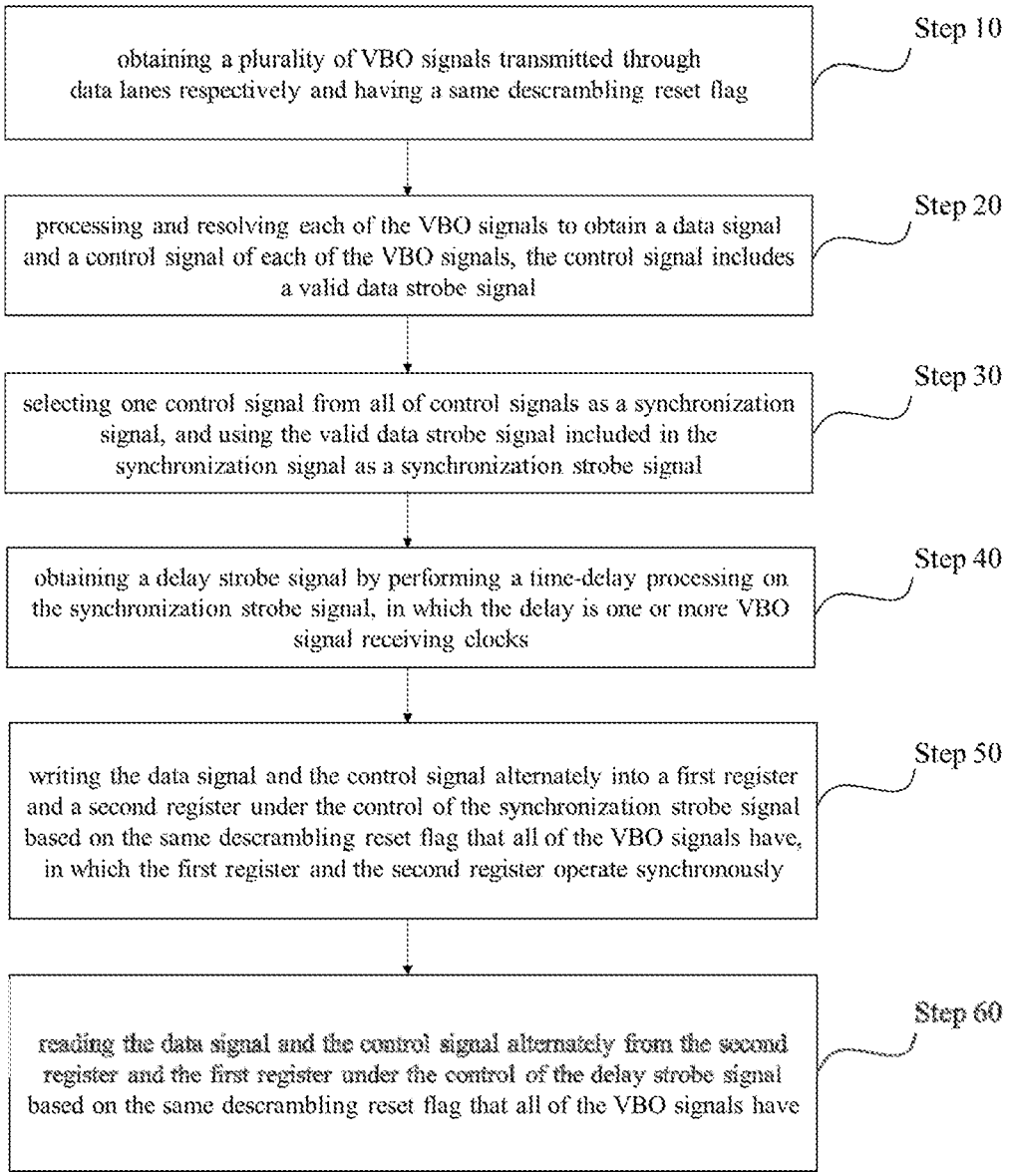
FIG. 1 is a schematic flowchart of a method of VBO signal processing for saving hardware resources.

The technical solutions of a method of VBO signal processing for saving hardware resources, and a device and terminal thereof in the embodiments of the present application will be clearly and completely described below in conjunction with the drawings in the specification. Obviously, the embodiments described are only a portion of the embodiments of the present application, not all of them. Based on the embodiments of the present application, other embodiments obtained by persons skilled in this art under premise of no creative efforts made belong to the protection scope of the present application.

In the description of the present application, it should be understood that directional terms or spatially relative terms such as "central", "longitudinal, "transverse", "length", "width", "thickness", "upper", "lower", "front, "back", "left", "right", "vertical", "horizontal", "top", "bottom", "inner", "outer" are orientations or directions with referring to the accompanying drawings, and are merely for describing the present invention and illustrating briefly, which does not indicate or imply that a referred equipment or device must have a specific orientation to construct and operate with a specific orientation. Therefore, it cannot be understood as a limitation to the embodiments of the present invention. In addition, terms such as "first", "second", "third" are only used for illustrating objects, and are not to be understood as indicating or implying relative importance or as implicitly including the number of technical features referred. Thus, the features defined with "first", "second", and "third" may explicitly or implicitly include one or more of features. In the description of the embodiments of the present invention, "multiple" means two or more, unless explicitly and specifically defined otherwise.

In the embodiments of the present invention, unless explicitly stated and limited otherwise, terms "to install", "to connect", "connection" should be understood broadly. For example, it may be a fix connection, a detachable connection, or an integral connection; it may be a mechanical connection, or an electrical connection; it may be directly connected, or may be indirectly connected through an intermediate medium, and may be an internal connection or an interaction relationship of two components, unless explicitly and defined otherwise. For persons skilled in this art, the specific meanings of the terms described above in the embodiments of the present invention may be understood according to specific circumstances.

In the embodiments of the present invention, the term "embodiment" is used to mean "serving as an example, instance, or illustration". Any embodiment described as "embodiment" in the embodiments of the present invention is not necessarily to be construed as being preferred or advantageous over other embodiments. In order to enable persons skilled in this art to implement and use the embodiments of the present invention, the following description is given. In the following description, the embodiments of the present invention are listed in detail for a purpose of explanation. It should be understood that persons skilled in this art can recognize that the embodiments of the present invention can be implemented even without using these specific details. In other embodiments, well-known structures and processes will not be described in detail to avoid unnecessary details from obscuring the description of the embodiments of the present invention. Therefore, the embodiments of the present invention are not intended to be limited to the illustrated embodiments, but should be consistent with the widest scope consistent with principles and features disclosed by the embodiments of the present invention.

Embodiment One

Facing a large number of linebuffers (or linebuffs) corresponding to independent data lanes respectively in an existing VBO signal processing scheme, which causes problems of serious hardware resource consumption, a large amount of hardware resources being used for VBO signal processing, difficulty of the linebuffers to give full play to performance, and higher cost, the present embodiment specifically provides a method of VBO signal processing for saving hardware resources. Under premise of using a same descrambling reset flag as a basis of reading and writing processing for subsequent signals, synchronization of VBO signals transmitted through different lanes is accomplished by writing into and reading from dual registers, so the VBO signals transmitted through multiple lanes can be processed without using a large number of the linebuffers (or linebuffs).

Refer to FIG. 1, which is a schematic flowchart of a method of VBO signal processing for saving hardware resources. The method is a way of using VBO signals RX (that is, receiving) for saving hardware resources. It can prevent the use of a large number of linebuffers, and only requires two synchronized register groups to complete the operations of accurate reading and writing for the VBO signals. Specifically, the method may include step 10 to step 60.

Figure 5:
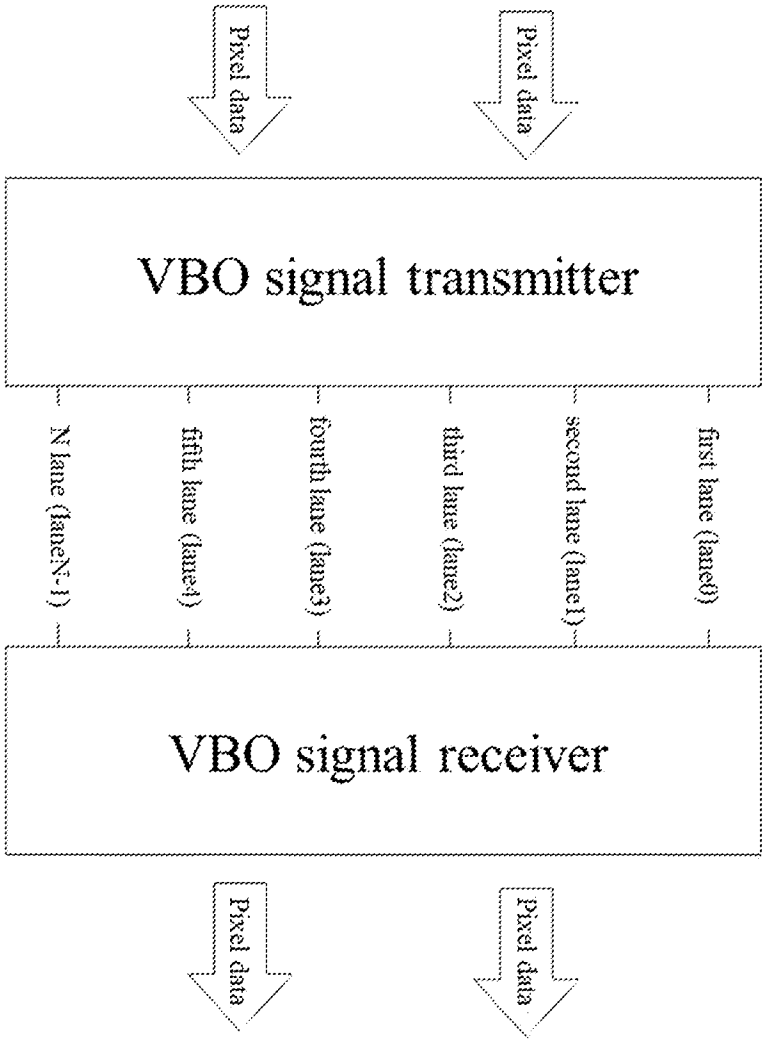
FIG. 5 is a schematic diagram showing an overall transmission architecture of VBO signals.

Step 10: obtaining a plurality of VBO signals transmitted through data lanes respectively and having a same descrambling reset flag. That is, all of the data lanes share one descrambling reset flag (BE_SR). Refer to FIG. 5, which is a schematic diagram showing an overall transmission architecture of VBO signals.

Figure 2:
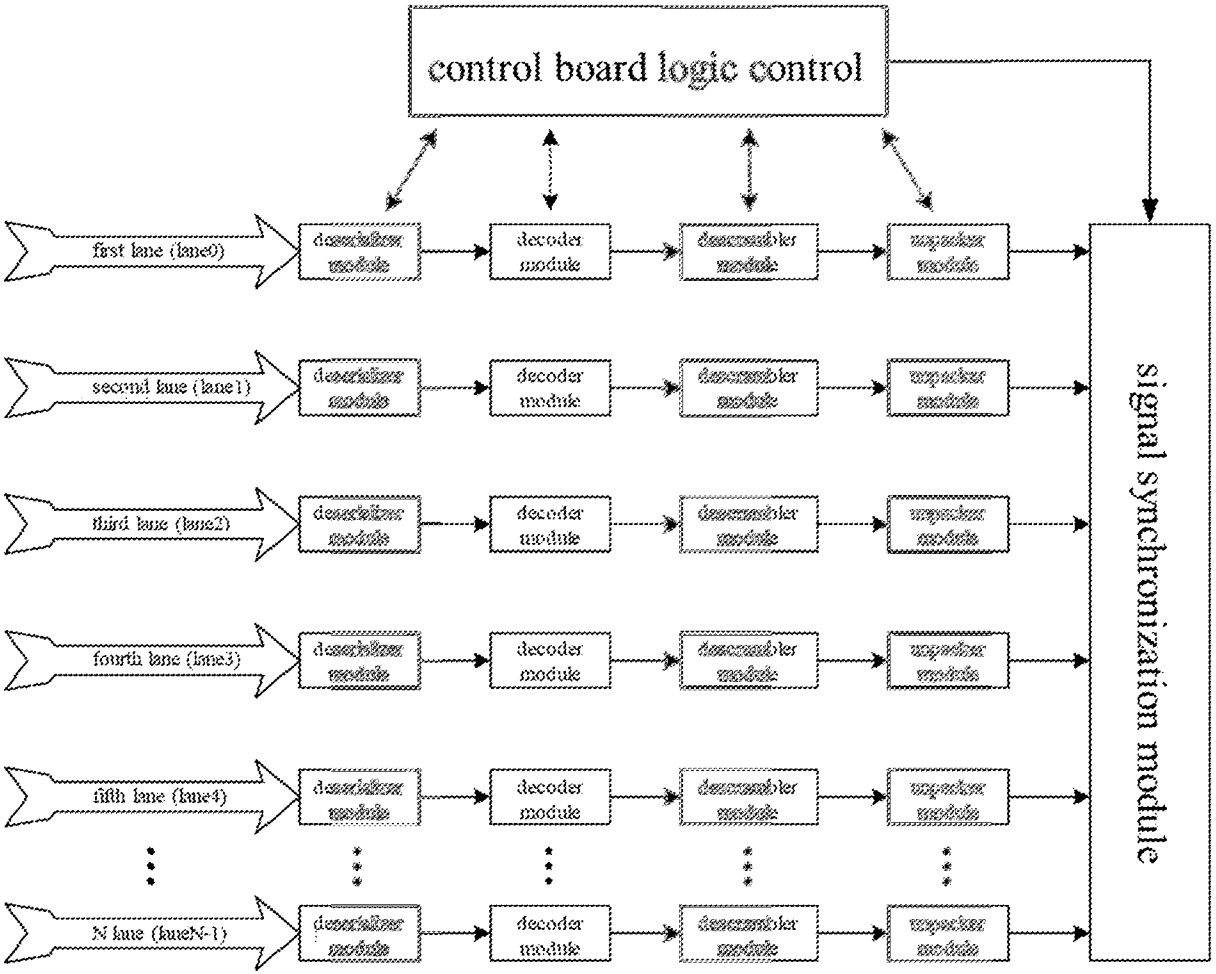
FIG. 2 is a schematic diagram showing a structure of a main frame inside a control panel of a liquid crystal display terminal.

Step 20: processing and resolving each of the VBO signals to obtain a data signal and a control signal of each of the VBO signals. The control signal includes a valid data strobe signal. In processing and resolving each of the VBO signals, the control signal often further includes a field synchronization signal (VS) and a row synchronization signal (HS), or the like. In the present embodiment, processing and resolving each of the VBO signals include the following four steps. Refer to FIG. 2 in conjunction with FIG. 1, FIG. 2 is a schematic diagram showing a structure of a main frame inside a control panel of a liquid crystal display terminal.

Figure 6:
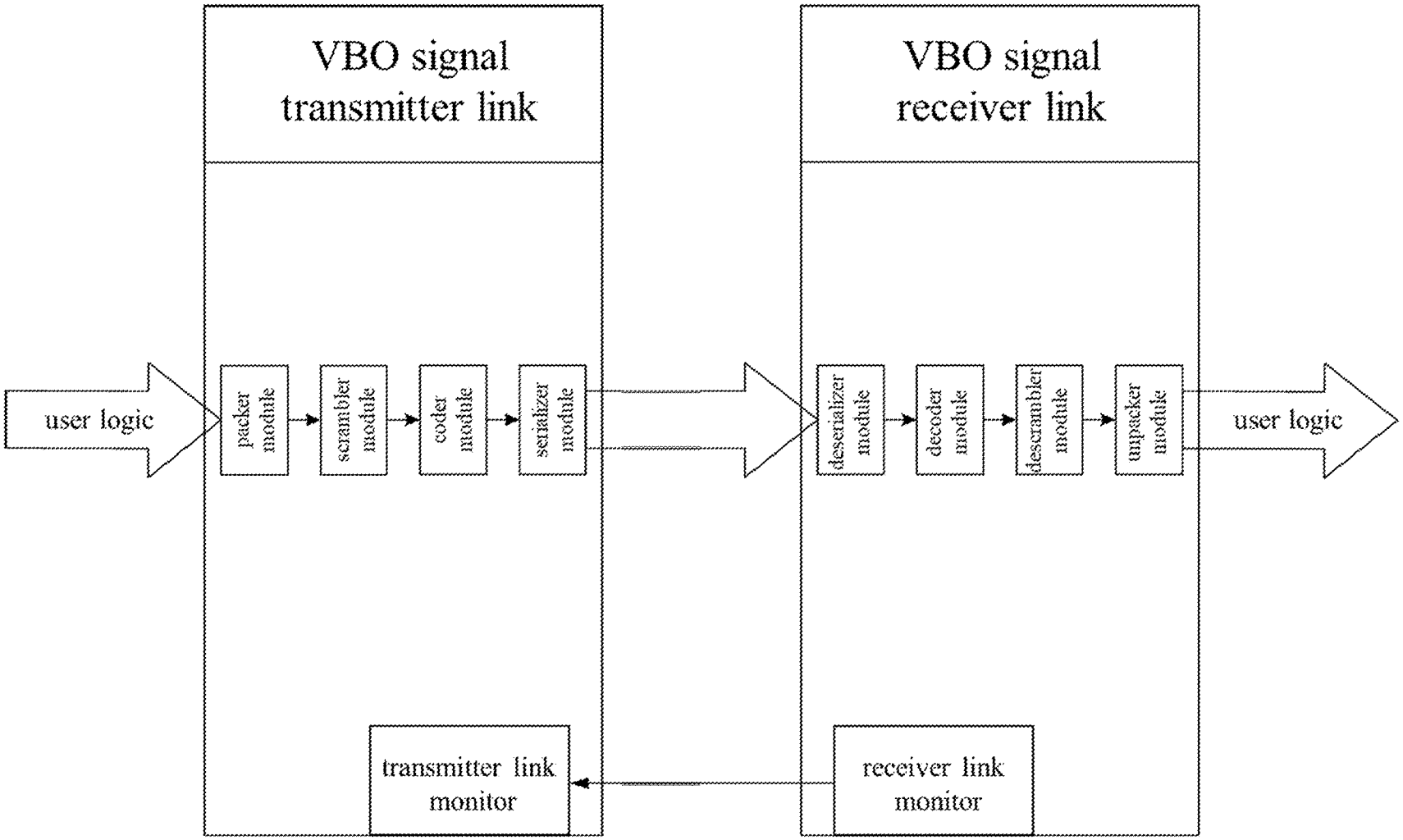
FIG. 6 is a schematic diagram showing an internal main frame of a transmission link of VBO signals.

A deserializer step, which converts an obtained serial VBO signal into a parallel VBO signal. In the present embodiment, the serial data with a rate of N*Y is converted into the parallel data with Y having a width of N-bit. As shown in FIG. 6, the step is an inverse process of a serializer step.

A decoder step, which decodes the parallel VBO signal into an identifiable signal, thereby decoding data into data that can be identified by subsequent circuits. As shown in FIG. 6, the step is an inverse process of an encoder step.

A descrambler step, as shown in FIG. 6, which is an inverse process of a scrambler step (a way of rearranging or encoding data to randomize data). The identifiable signal is descrambled in the descrambler step.

An unpacker step, that is, a mapping of corresponding data, which unpacks the descrambled identifiable signal to obtain the data signal and control signal of each of the VBO signals. As shown in FIG. 6, the step is an inverse process of a packer step.

Step 30: selecting one control signal from all of the control signals as a synchronization signal, and using the valid data strobe signal (DE) included in the synchronization signal as a synchronization strobe signal. Wherein, selection criteria or standards may be established in advance through a program setting or the like, and no further elaboration on details will be made in the present embodiment. Specifically, in the present embodiment, the valid data strobe signal (DE) generated after unpacking a signal transmitted through a first lane (lane0) is taken as a synchronization strobe signal to generate subsequent delay strobe signal and corresponding logic control flow.

Step 40: further obtaining a delay strobe signal by performing time-delay processing on the synchronization strobe signal, in which a duration of delay is one or more VBO signal receiving clocks. As a preferred technical solution, the delay strobe signal is obtained by delaying the synchronization strobe signal by one clock according to the present embodiment, as shown in FIG. 4, which is a schematic diagram showing a working time sequence of a device of VBO signal processing, wherein DE and DE_R respectively indicate the two strobe signals before and after the delay.

Figure 3:
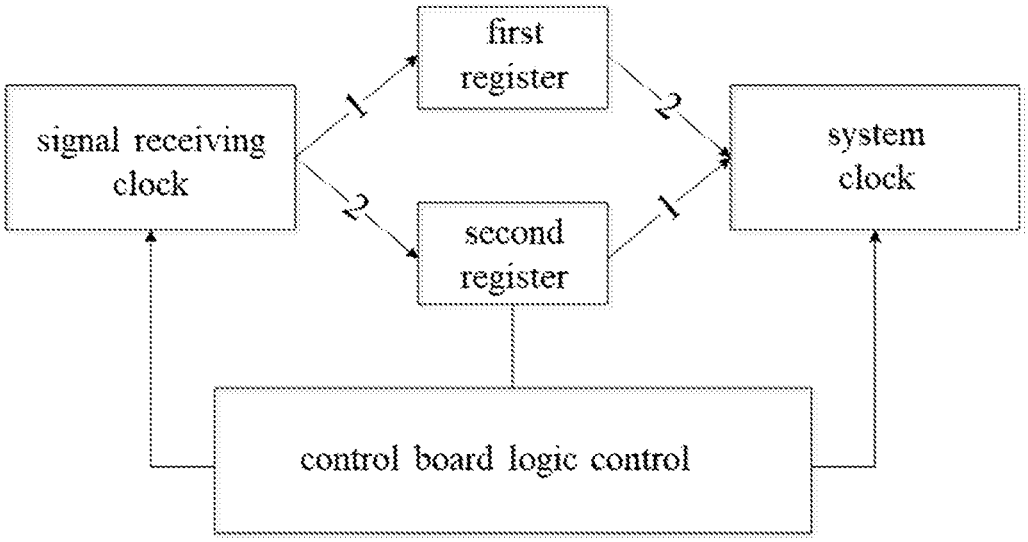
FIG. 3 is a schematic diagram of a principle of VBO signals performing reading and writing operations.

Step 50: a signal must be written through linebuffers (or linebuffs) corresponding to the respective lanes in the prior art. Compared with the prior art, a large number of linebuffers can be reduced or even omitted according to the embodiment of the present invention, thereby achieving a purpose of saving hardware resources. Specifically, refer to FIG. 3, which is a schematic diagram of a principle of VBO signals performing reading and writing operations. Based on the same descrambling reset flag that all of the VBO signals have, that is, all of the VBO signals have the same flag used for descrambling and resetting in the step of writing, the data signals and control signals are written alternately into a first register and a second register sequentially under control of the synchronization strobe signal, in which the first register and the second register operate synchronously in the present embodiment. In writing signals (that is, data) alternately into the first register and the second register, a signal receiving clock is taken as a working clock in writing the data signal and the control signal alternately into the first register and the second register.

Figure 4:
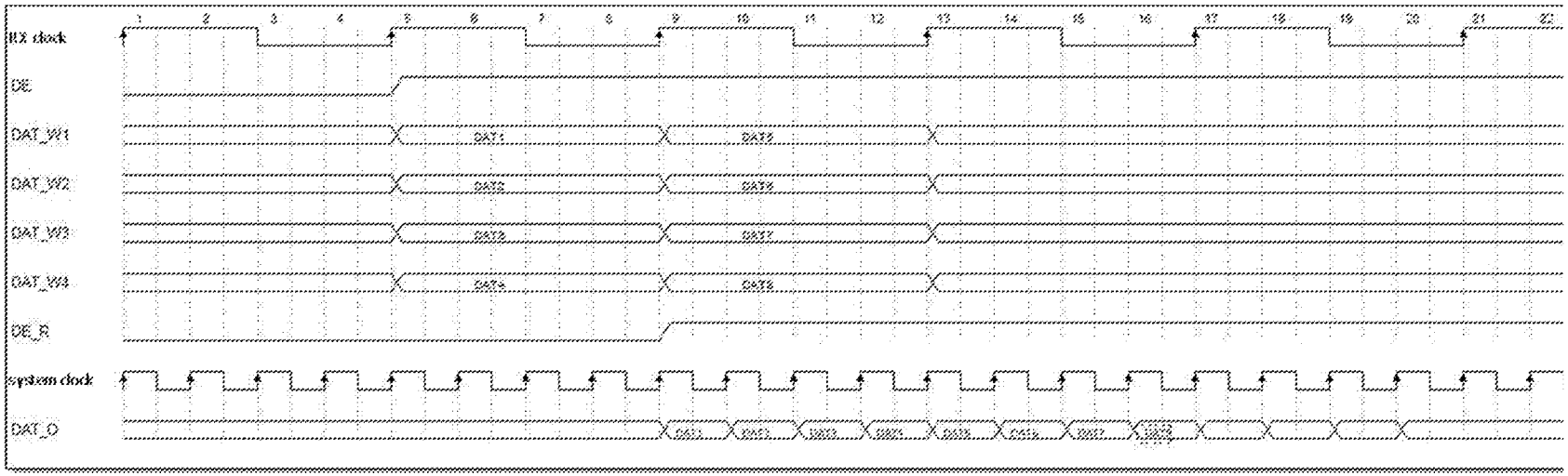
FIG. 4 is a schematic diagram showing a working time sequence of a device of VBO signal processing.

Refer to FIG. 4, which is a schematic diagram showing a working time sequence of a device of VBO signal processing. In FIG. 4, RX clock indicates the signal receiving clock, DE indicates the synchronization strobe signal, DE_R indicates the delay strobe signal, a system clock is a working clock of a main board of a liquid crystal display terminal, DAT_W1 indicates data (that is, signal) transmitted through the first data lane, DAT_W2 indicates data (that is, signal) transmitted through a second data lane, DAT_W3 indicates data (that is, signal) transmitted through a third data lane, DAT_W4 indicates data (that is, signal) transmitted through a fourth data lane, and DAT_O indicates signals read according to step 60 and output to a liquid crystal display screen.

Step 60: a signal must be read through linebuffers (or linebuffs) corresponding to the respective lanes in the prior art. Compared with the prior art, a large number of linebuffers can be reduced or even omitted according to the embodiment of the present invention, thereby achieving the purpose of saving hardware resources. Specifically, refer to FIG. 3, which is a schematic diagram of a principle of VBO signals performing reading and writing operations. Based on the same descrambling reset flag that all of the VBO signals have, that is, all of the VBO signals have the same flag used for descrambling and resetting in the step of reading, the data signals and control signals are read alternately from the second register and the first register sequentially under control of the delay strobe signal to complete a synchronization control of signals (that is, data) obtained from the respective data lanes for providing a suitable signal source for a normal display of the liquid crystal display terminal. In reading signals (that is, data) alternately from the first register and the second register sequentially, a system clock may be taken as a working clock in reading the data signal and the control signal alternately from the first register and the second register. Refer to FIG. 4, which is a schematic diagram showing a working time sequence of a device of VBO signal processing. The system clock in the present embodiment is a working clock of a main board of the liquid crystal display terminal. In order to complete the reading of the VBO signals more reliably, the first register and the second register in the present embodiment are multi-bit (Nbit) registers, thereby completing corresponding signal synchronization operations.

It should be understood that the steps described above may be performed in sequential order according to actual circumstances, or performed in a parallel manner or in a staggered manner according to actual circumstances. For example, after performing step 50 once, step 60 starts to be performed simultaneously with step 50, thereby completing the steps of signal reading and writing.

Embodiment Two

Based on the same inventive concept as the embodiment one, the present embodiment further provides a device of VBO signal processing, which is used for realizing the method of VBO signal processing for saving hardware resources in the embodiment one, and is specifically described below.

The device includes a signal obtaining module, a signal analysis module, a signal synchronization module, a time-delay processing module, a signal writing module, and a signal reading module.

The signal obtaining module is configured to obtain a plurality of VBO signals transmitted through data lanes respectively and having a same descrambling reset flag. Each of the data lanes shares one descrambling reset flag (BE_SR). Refer to FIG. 5, which is a schematic diagram showing an overall transmission architecture of VBO signals.

The signal analysis module is configured to process and resolve each of the VBO signals to obtain a data signal and a control signal of each of the VBO signals. The control signal includes a valid data strobe signal.

As an improved technical scheme, the signal analysis module includes a deserializer module, a decoder module, a descrambler module, and an unpacker module. Refer to FIG. 2 and FIG. 6 simultaneously, FIG. 2 is a schematic diagram showing a structure of a main frame inside a control panel of a liquid crystal display terminal, and FIG. 6 is a schematic diagram showing an internal main frame of a transmission link of VBO signals. A left-half part of FIG. 6 shows a host link of a VBO signal transmitter, a right-half part of FIG. 6 shows a host link of a VBO signal receiver, and a receiver link monitor shown in the right-half part can be configured to send real-time working status of the receiver link to a transmitter link monitor, thereby realizing coordinated work between the receiver and the transmitter.

The deserializer module is configured to convert an obtained serial VBO signal into a parallel VBO signal.

The decoder module is configured to decode the parallel VBO signal into an identifiable signal.

The descrambler module is configured to descramble the identifiable signal.

The unpacker module is configured to unpack the descrambled identifiable signal to obtain the data signal and control signal of each of the VBO signals.

The signal synchronization module is configured to select one control signal from all of the control signals as a synchronization signal, and is configured to use the valid data strobe signal included in the synchronization signal as a synchronization strobe signal. The signal synchronization module can also be understood as a specific hardware which is a module disposed in a control board data synchronizer.

The time-delay processing module is configured to obtain a delay strobe signal by performing time-delay processing on the synchronization strobe signal, in which a duration of delay is one or more VBO signal receiving clocks. In a specific embodiment and as a preferred technical scheme, the delay strobe signal is obtained by delaying the synchronization strobe signal by one clock in the present embodiment, as shown in FIG. 4. That is, the delay strobe signal DE_R described above is one signal receiving (RX) clock later than the synchronization strobe signal.

For the signal writing module, a signal must be written through linebuffers (or linebuffs) corresponding to the respective lanes in the prior art. Compared with the prior art, a large number of linebuffers can be reduced or even omitted according to the embodiment of the present invention, thereby achieving a purpose of saving hardware resources. Specifically, refer to FIG. 3, which is a schematic diagram of a principle of VB 0 signals performing reading and writing operations. In the present embodiment, all of the VBO signals have the same flag used for descrambling and resetting in the step of writing. The signal writing module is used to write the data signals and control signals alternately into the first register and the second register (write to the first register first, then to the second register) under control of the synchronization strobe signal based on the same descrambling reset flag that all of the VBO signals have, in which the first register and the second register operate synchronously. In a specific embodiment, the signal writing module provided by the embodiment of the present invention is configured to take a signal receiving clock as a working clock in writing data signal and control signal alternately into the first register and the second register. Refer to FIG. 4, which is a schematic diagram showing a working time sequence of a device of VBO signal processing. In FIG. 4, RX clock indicates the signal receiving clock, DE indicates the synchronization strobe signal, DE_R indicates the delay strobe signal, a system clock is a working clock of a main board of a liquid crystal display terminal, DAT_W1 indicates data (that is, signal) transmitted through a first data lane, DAT_W2 indicates data (that is, signal) transmitted through a second data lane, DAT_W3 indicates data (that is, signal) transmitted through a third data lane, DAT_W4 indicates data (that is, signal) transmitted through a fourth data lane, and DAT_O indicates a signal read by the signal reading module and output to a liquid crystal display screen.

For the signal reading module, a signal must be read through linebuffers (or linebuffs) corresponding to the respective lanes in the prior art. Compared with the prior art, a large number of linebuffers can be reduced or even omitted according to the embodiment of the present invention, thereby achieving the purpose of saving hardware resources. Specifically, refer to FIG. 3, which is a schematic diagram of a principle of VBO signals performing reading and writing operations. In the present embodiment, all of the VBO signals have the same flag used for descrambling and resetting in the step of reading. The signal reading module is used to read the data signal and control signal alternately from the second register and the first register under control of the synchronization strobe signal based on the same descrambling reset flag that all of the VBO signals have to complete a synchronization control of signals (that is, date) obtained from the respective data lanes for providing a suitable signal source for a normal display of the liquid crystal display terminal. In a specific embodiment, the signal reading module provided by the embodiment of the present invention is further configured to take a system clock as a working clock in reading the data signal and the control signal alternately from the second register and the first register. Refer to FIG. 4, which is a schematic diagram showing a working time sequence of a device of VBO signal processing. In order to complete the reading of the VBO signals more reliably, the first register and the second register in the present embodiment are multi-bit (Nbit) registers, thereby completing corresponding signal synchronization operations.

Embodiment Three

A terminal, which is a liquid crystal display terminal, and the terminal includes any one of the equipment of VBO signal processing for saving hardware resources in embodiment two. In a specific embodiment, the terminal can be used on a display screen of devices such as smartphones, tablet computers, laptops, smart bracelets, and smart glasses.

The above are only preferred embodiments of the embodiments of the present invention, and are not intended to limit the embodiments of the present invention. Any modification, equivalent replacement, and simple improvement made on the substance of the embodiments of the present invention shall be included in the protection scope of the embodiments of the present invention.

Industrial applicability: the processing of the VBO signals can be optimized to completely resolve the problem of excessive occupation of hardware resources in the prior art according to the present invention. Under premise of improving the accuracy and reliability of VBO signal transmission, hardware complexity is significantly reduced and software design logic is simplified. It is suitable for driving large-screen liquid crystal display (LCD) terminals, such as LCD TVs. It has a broad market application prospect and is suitable for large-scale promotion and application.

What is claimed is:

1. A method of V-By-One (VBO) signal processing for saving hardware resources, comprising steps of:

obtaining a plurality of VBO signals transmitted through data lanes respectively and having a same descrambling reset flag;

processing and resolving each of the VBO signals to obtain a data signal and a control signal of each of the VBO signals, wherein the control signal comprises a valid data strobe signal;

selecting one control signal from all of the control signals as a synchronization signal, and using the valid data strobe signal comprised in the synchronization signal as a synchronization strobe signal;

obtaining a delay strobe signal by performing time-delay processing on the synchronization strobe signal, in which a duration of delay is one or more VBO signal receiving clocks;

writing the data signal and the control signal alternately into a first register and a second register under control of the synchronization strobe signal based on the same descrambling reset flag that all of the VBO signals have, in which the first register and the second register operate synchronously; and reading the data signal and the control signal alternately from the second register and the first register under control of the delay strobe signal based on the same descrambling reset flag that all of the VBO signals have.

2. The method as claimed in claim 1, wherein processing and resolving each of the VBO signals comprises steps of:

converting an obtained serial VBO signal into a parallel VBO signal;

decoding the parallel VBO signal into an identifiable signal;

descrambling the identifiable signal; and unpacking the descrambled identifiable signal to obtain the data signal and control signal of each of the VBO signals.

3. The method as claimed in claim 1, wherein a signal receiving clock is taken as a working clock in writing the data signal and the control signal alternately into the first register and the second register.

4. The method as claimed in claim 1, wherein a system clock is taken as a working clock in reading the data signal and the control signal alternately from the second register and the first register.

5. The method as claimed in claim 1, wherein in the step of processing and resolving each of the VBO signals, the control signal further comprises a field synchronization signal and a row synchronization signal.

* * * * *